US005597329A

United States Patent [19]

Takano et al.

[11] Patent Number: 5,597,329

[45] Date of Patent: Jan. 28, 1997

[54] CONNECTOR ATTACHMENT COMPONENT

[75] Inventors: Tsunesuke Takano; Kouichi Sinzawa, both of Tokyo, Japan

[73] Assignee: Daiichi Denso Buhin Co., Ltd., Japan

[21] Appl. No.: 332,531

[22] Filed: Oct. 31, 1994

[30] Foreign Application Priority Data

Nov. 15, 1993 [JP] Japan ..... 5-065716 U
Dec. 17, 1993 [JP] Japan ..... 5-072802 U

[51] Int. Cl.[6] ..... H01R 19/40

[52] U.S. Cl. ..... 439/699.2

[58] Field of Search ..... 439/699.2, 698, 439/621

[56] References Cited

U.S. PATENT DOCUMENTS

| | | | |
|---|---|---|---|
| 4,610,497 | 9/1986 | Tsuchida et al. | 439/699.2 |
| 4,957,455 | 9/1990 | Horiuchi et al. | 439/699.2 |
| 5,049,092 | 9/1991 | Takano et al. | 439/621 |
| 5,082,452 | 1/1992 | Takano | 439/621 |
| 5,108,314 | 4/1992 | Takano et al. | 439/621 |

FOREIGN PATENT DOCUMENTS 53-1825 1/1978 Japan .

*Primary Examiner*—Gary F. Paumen
*Attorney, Agent, or Firm*—Nixon & Vanderhye P.C.

[57] ABSTRACT

A connector component for a wedge-base lamp includes an electrically insulative base having an upright inverted T-shaped electrically insulated frame member which defines a central interior rectangular space for receiving a wedge-base of a lamp. The insulated frame member also has an opposed pair of lateral shoulder pockets which open into a lower portion of the central interior rectangular space. A pair of opposed bulb guides integral with the frame member are disposed substantially midway of the interior rectangular space. The opposed bulb guides each define a respective arcuate concavity for receiving a portion of the wedge-base of the lamp therein so as to provide a holder for the wedge-base lamp. The bulb guides further define a pair of lateral socket spaces within the interior rectangular space of the frame member and each have a projection member extending into the socket space. A pair of U-shaped electrically conductive clamp elements are positioned in a respective one of the lateral socket spaces. Each clamp element has (i) an attachment aperture which receives a projection member of a respective socket space to positionally restrain the clamp element therewithin, and (ii) a lateral connection piece positioned within a respective lateral shoulder pocket for connection to a bus bar.

1 Claim, 17 Drawing Sheets

CONNECTOR ATTACHMENT COMPONENT

FIELD OF INVENTION

The present invention relates to a connector attachment component that is adapted to attach a wedge base bulb or a flat fuse to a connector by means of a flat holder.

DESCRIPTION OF THE PRIOR ART

An example of a conventional small lamp using a wedge base bulb is described in Japanese Examined Utility Model Publication No. 53-1825. Specifically, this example of the prior art is a small interior lamp for automobile use equipped with a housing, a lens located in the opening of said housing, a holder attached to the housing, and a wedge base bulb supported in the holder. The holder includes a holder body, formed by a bent U-shaped conductive metal strip, and an attachment piece integrated into a single unit with the holder body and extending in the opposite direction from the U-shaped conductive metal strip. A center piece and right and left side pieces are provided in opposition at selected intervals protruding from the top and bottom of the engaging indentation. The U-shaped portion of the holder body is clamped between the center piece and both the side pieces by fitting into the engaging indentation. In such a manner, therefore, the holder body is formed in the housing. In this state, the attachment piece of the holder body is fixed in the housing together with a conductive strip for connection. Since the prior art described above comprises an interior lamp by directly forming the holder portion of a wedge base bulb in the side edge of a hole in an interior lamp housing, and directly inserting a connector into a housing base, there is a tendency for the bulb to become loose due to thermal deformation of the base caused by accumulation of heat in the bulb holder. Such looseness is particularly acute when bulbs of roughly 5 W or more are used. Moreover, contact resistance increases in riveted portions resulting in a further accelerated increase in looseness, ultimately leading the interior lamp not being operational.

In addition, the prior art is also disadvantageous since the peripheral members of the connector, such as the bulb holder, have a relatively complex structure. Such a complex structure therefore typically requires manual assembly and connection thereby making it unsuitable for automated wiring and assembly systems.

SUMMARY OF THE INVENTION

The present invention eliminates many of the above-mentioned problems associated with the prior art while also providing an inexpensive and reliable bulb and fuse holding structure by integrally providing an upright and relatively small holder which holds a wedge base bulb on a relatively large plastic base. The present invention therefore is well suited for automated connection and mounting of a connector to other circuits within the holder, including attachment of the connector to the holder.

The present invention is embodied in a connector component for a wedge-base lamp which includes an electrically insulative base having an upright inverted T-shaped electrically insulated frame member which defines a central interior rectangular space for receiving a wedge-base of a lamp. The insulated frame member also has an opposed pair of lateral shoulder pockets which open into a lower portion of the central interior rectangular space. A pair of opposed bulb guides integral with the frame member are disposed substantially midway of the interior rectangular space. The opposed bulb guides each define a respective arcuate concavity for receiving a portion of the wedge-base of the lamp therein so as to provide a holder for the wedge-base lamp. The bulb guides further define a pair of lateral socket spaces within the interior rectangular space of the frame member and each have a projection member extending into the socket space.

A pair of U-shaped electrically conductive clamp elements are positioned in a respective one of the lateral socket spaces. Each clamp element has (i) an attachment aperture which receives a projection member of a respective socket space to positionally restrain the clamp element therewithin, and (ii) a lateral connection piece positioned within a respective lateral shoulder pocket for connection to a bus bar.

Thus, since the lamp (or fuse) is surrounded by an open area, heat generated by the lamp is effectively released by convection and radiation. In addition, since the heat of the connector is effectively released through a narrow conductive strip provided continuously on each connector, local temperature increases of the insulated frame and box frame are minimized.

BRIEF DESCRIPTION OF THE ACCOMPANYING DRAWINGS

DESCRIPTION OF THE PREFERRED EMBODIMENTS

Figure 1:
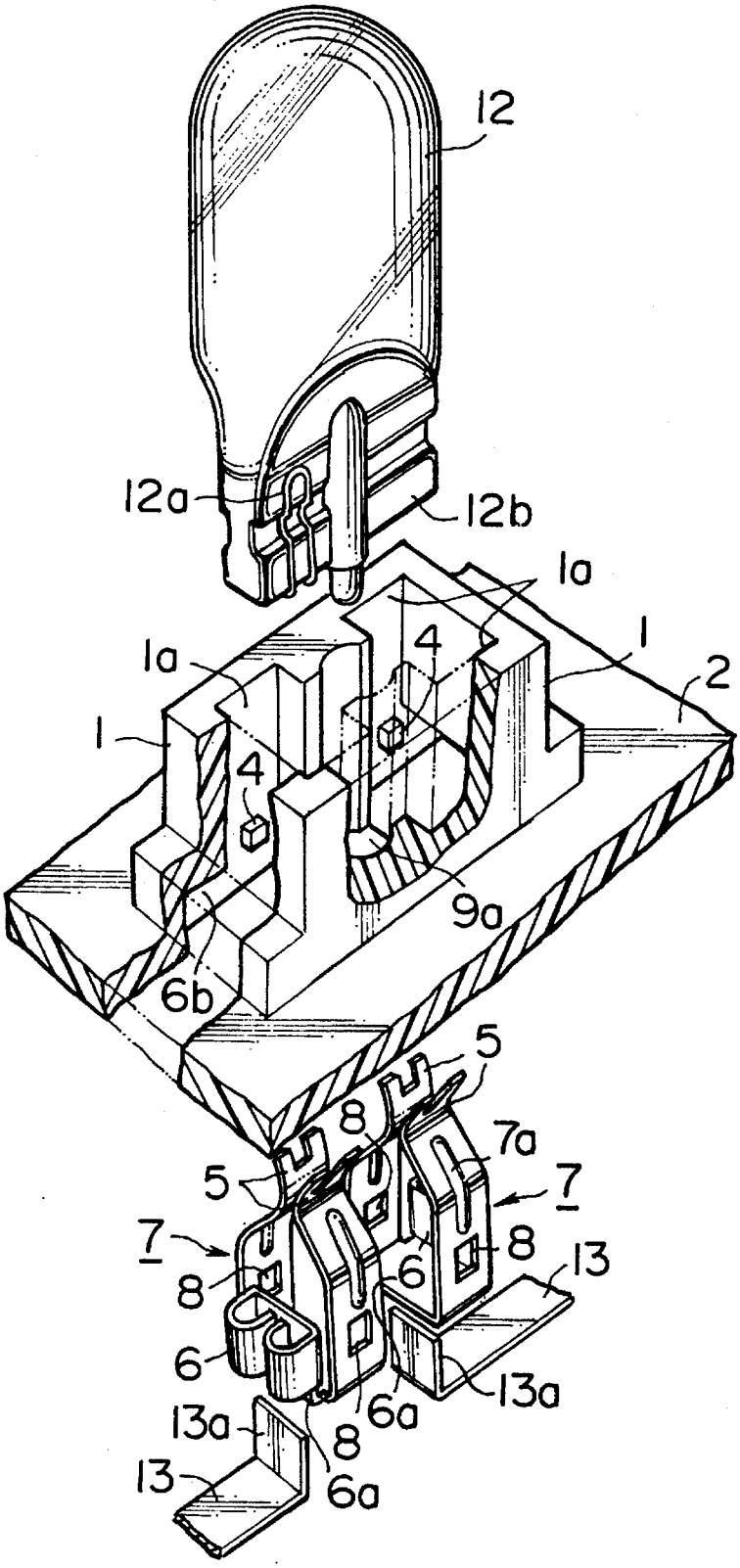
FIG. 1 is an exploded perspective view of an embodiment of the present invention.
Figure 2:
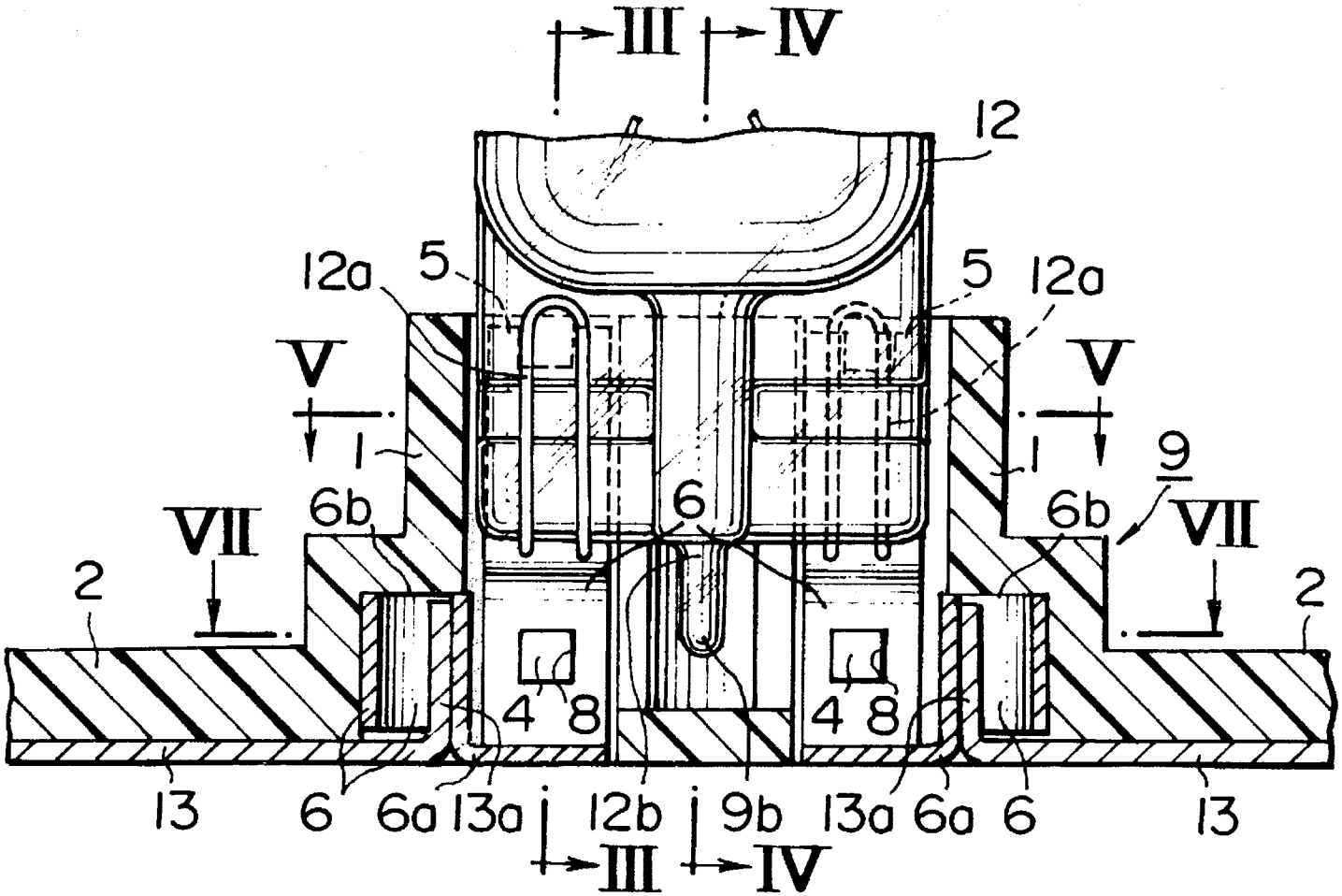
FIG. 2 is a vertical cross-sectional view of the apparatus as an embodiment of the present invention.
Figure 3:
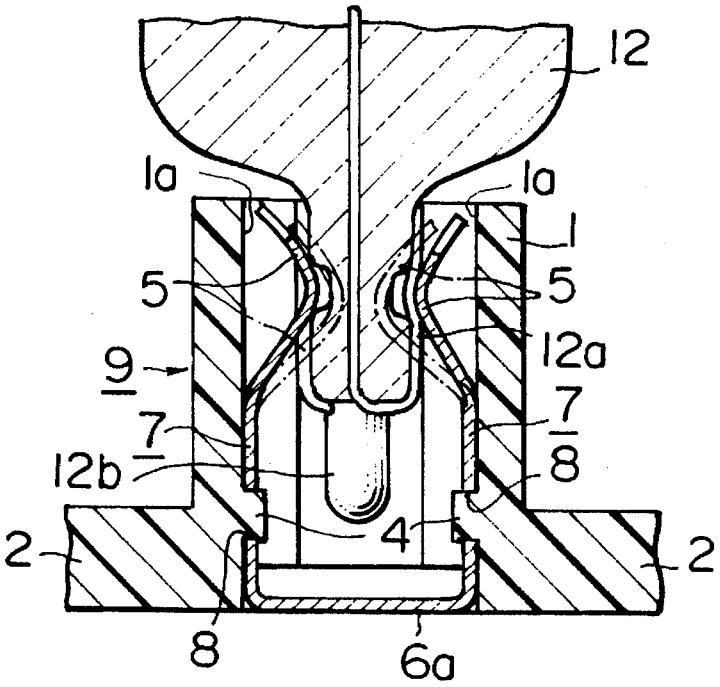
FIG. 3 is a cross-sectional view taken along line III—III of FIG. 2.
Figure 4:
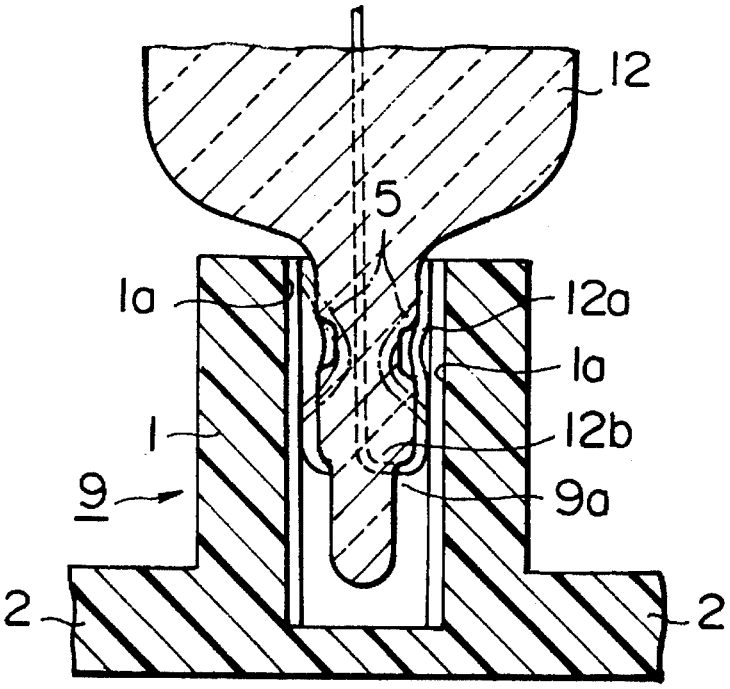
FIG. 4 is a cross-sectional view taken along line IV—IV of FIG. 2.
Figure 5:
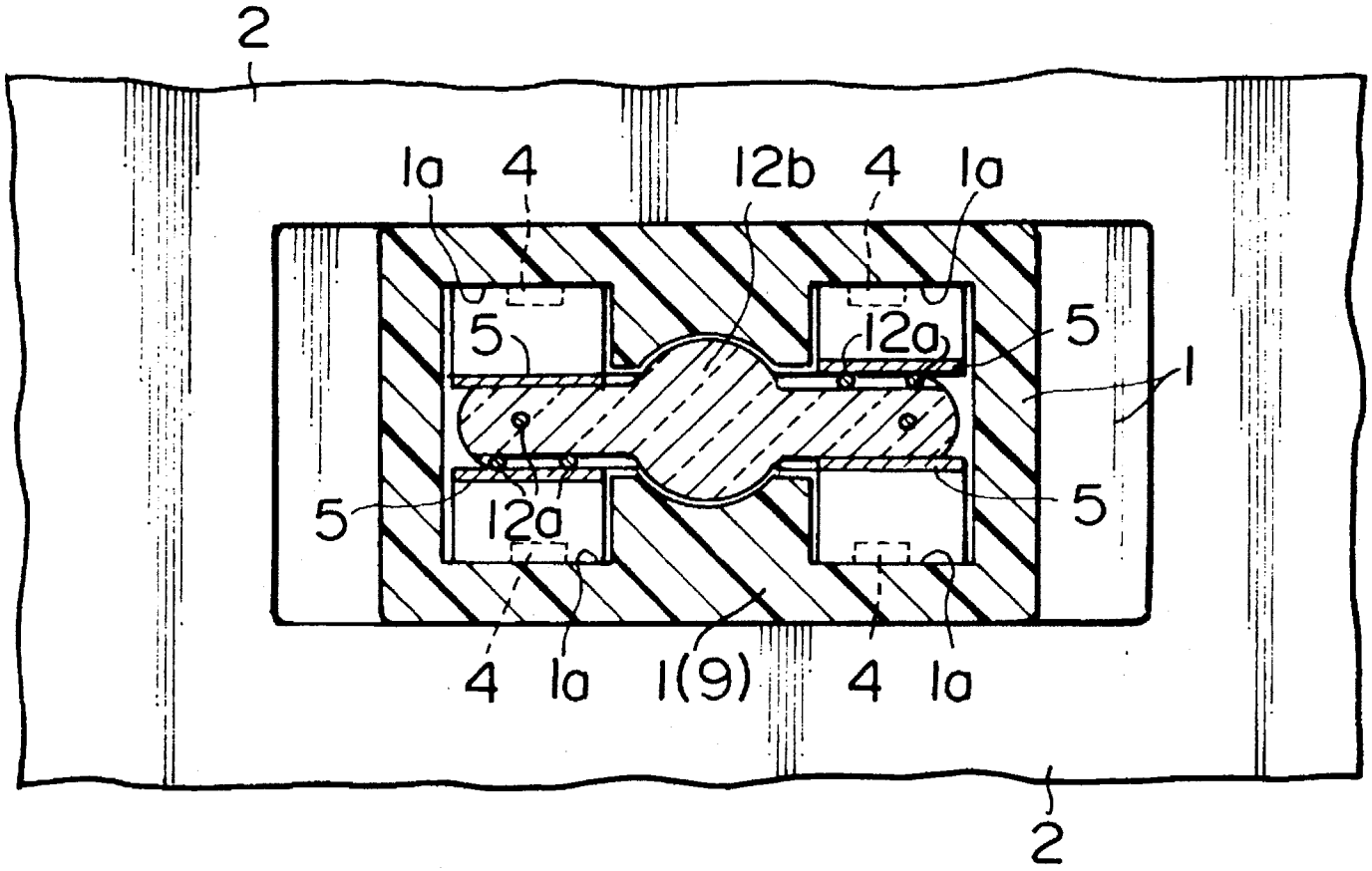
FIG. 5 is a cross-sectional view taken along line V—V of FIG. 2.
Figure 6:
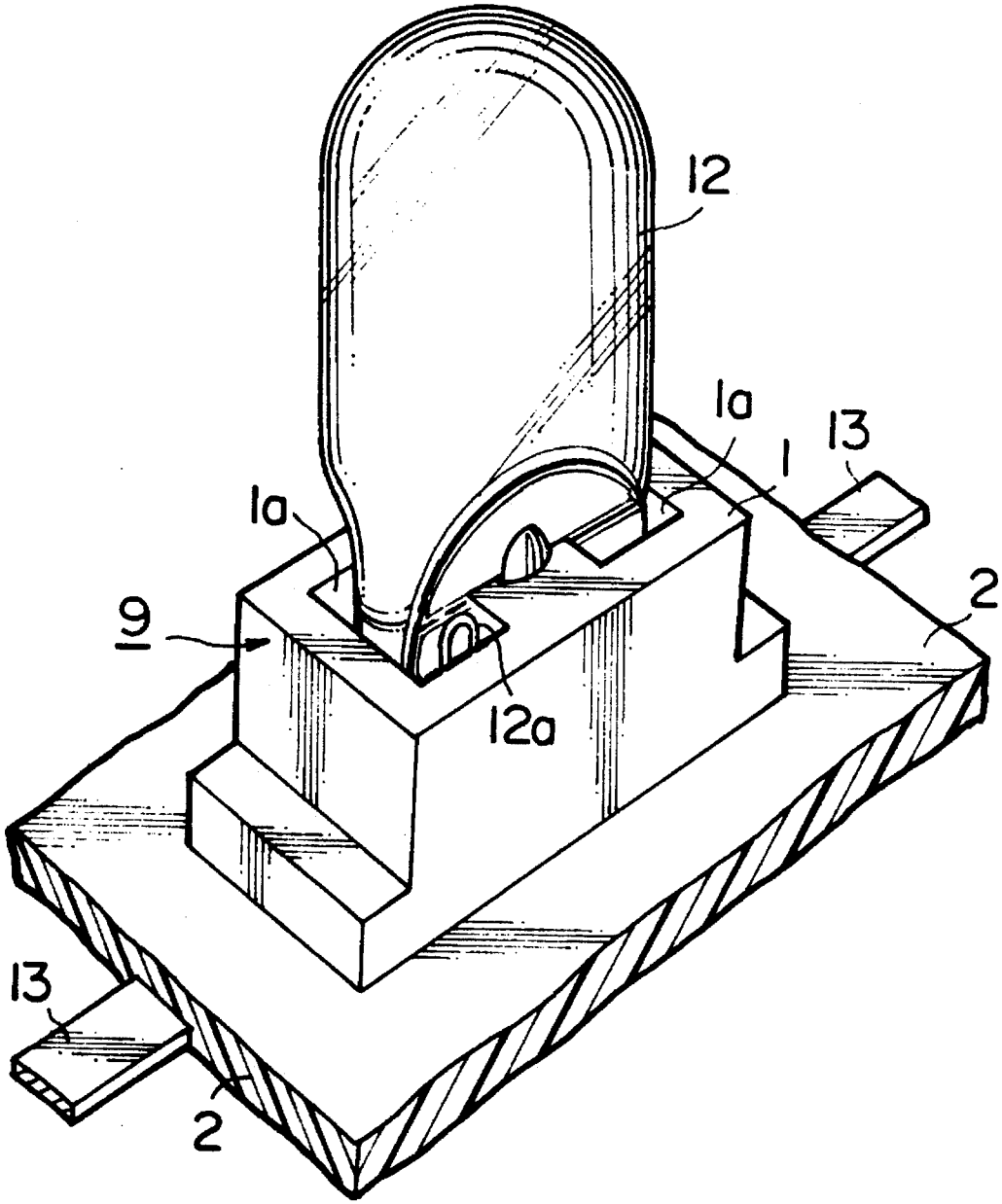
FIG. 6 is a perspective view indicating an example of use of the present invention.

The basic constitution of one embodiment of this invention is shown in accompanying FIGS. 1–7. In this regard, the connector component according to the present invention is provided with projections 4 protruding in opposition to each other as shown in FIG. 3 on opposing inner surfaces I a of an insulated frame 1. The frame 1 is formed into the shape of a square cylinder in the manner of an inverted "T" as shown in FIG. 1 on base 2 which is made of a relatively inexpensive heat-resistant plastics material, such as polypropylene. As shown in FIG. 1, a pair of connectors 7 are provided which are respectively and integrally equipped with a pair of resilient generally U-shaped conductive clamps formed of phosphor bronze and the like. Eyeglass-shaped insertion connection pieces 6 are formed laterally on the side edge rising bases 6*a*, and are inserted into the insulated frame 1 as shown in FIGS. 3–5. In this regard, it will be noted particularly from FIG. 1 that the lateral connection pieces 6 are positioned within the lateral shoulder pockets 6*b* formed at the lower end of the inverted T-shaped housing 1.

Rising base 6*a* of the connection piece 6 is inserted into the frame side groove 1*b* as the clamps 5 are inserted between the opposing inner surfaces 1*a* and are thereby narrowed in opposition to their resilient force. The pair of projections 4 are then engaged with a snapping action (i.e., due to clamps 5 being returned to their original positions by their resilient force) into attachment holes 8 formed in the bases of clamps 5. The connectors 7 are then respectively attached as shown in FIG. 3 on both sides between the opposing inner surfaces 1 a thereby forming the bulb holder 9.

If the connector provided with two protruding ribs 7*a* as shown in FIG. 1 is used for the connector 7 as described above, then the clamping resiliency can be strengthened thereby resulting in improved radiation of heat.

In use, a known wedge base bulb 12 like that shown in FIG. 1 may be inserted into the holder 9 from the state shown with broken line in FIG. 3 to the state shown in solid line in that same drawing. During insertion of the bulb 12, its bulb base 12*b* makes contact with holder flange 9*a* which responsively spreads apart clamps 5 of connector 7 with leads 12*a* of bulb 12 in opposition to the resilient force of each of the clamps. Bulb 12 can thus be attached in holder 9 as shown.

Figure 7:
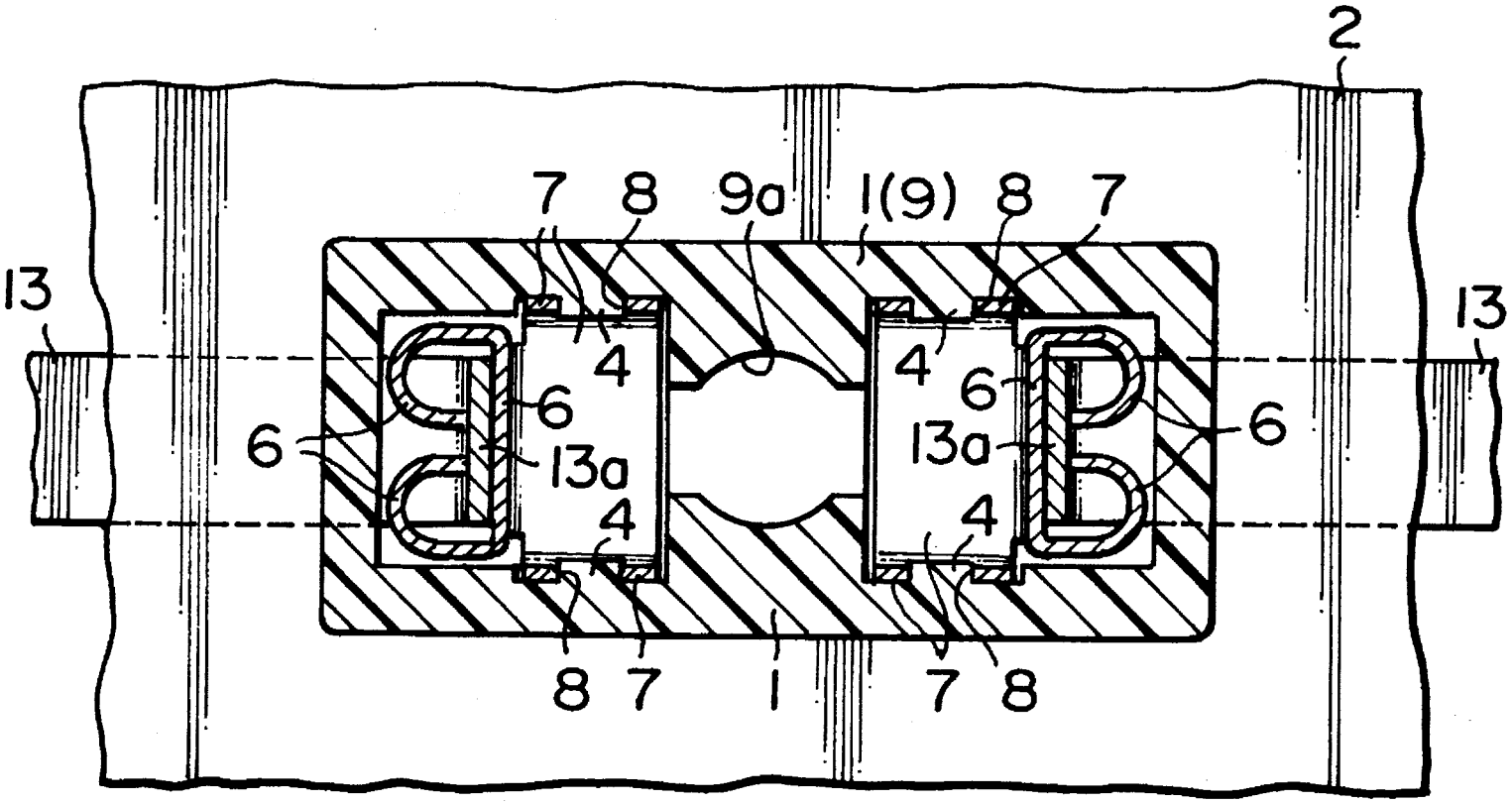
FIG. 7 is a cross-sectional view taken along line VI—VI of FIG. 2.

In addition, wedge base bulb 12 can then be illuminated by tightly inserting BUS bars 13 arranged along the surface of attaching body 11 into insertion connection pieces 6 of connectors 7 at their bent portions 13*a* as shown in FIGS. 2 and 7 resulting in electrical continuity.

Although the discussion above exemplifies the use of a wedge base bulb 12, the holder 9 could likewise be provided with a conventional fuse element.

Figure 8:
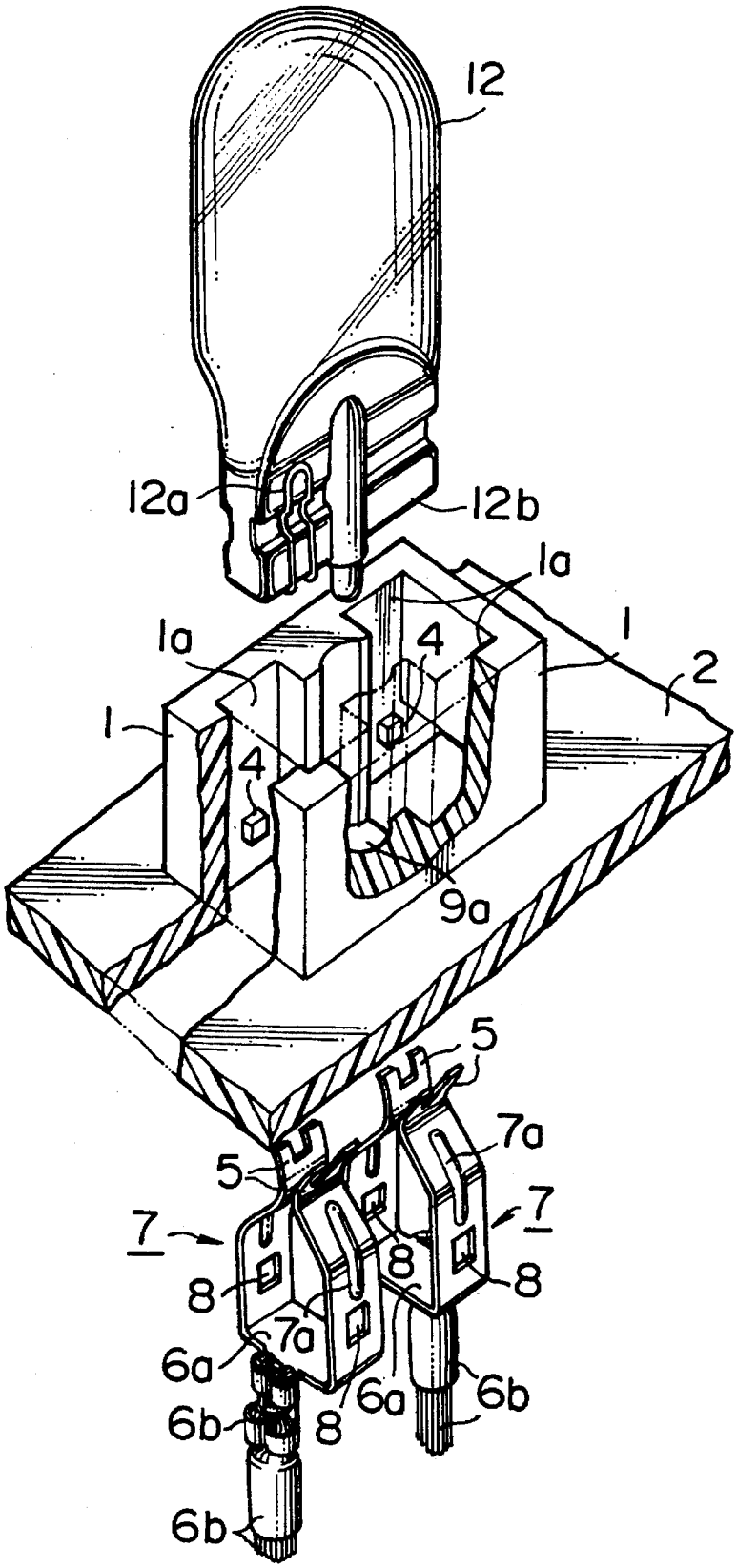
FIG. 8 is an exploded perspective view of an embodiment of the present invention.
Figure 9:
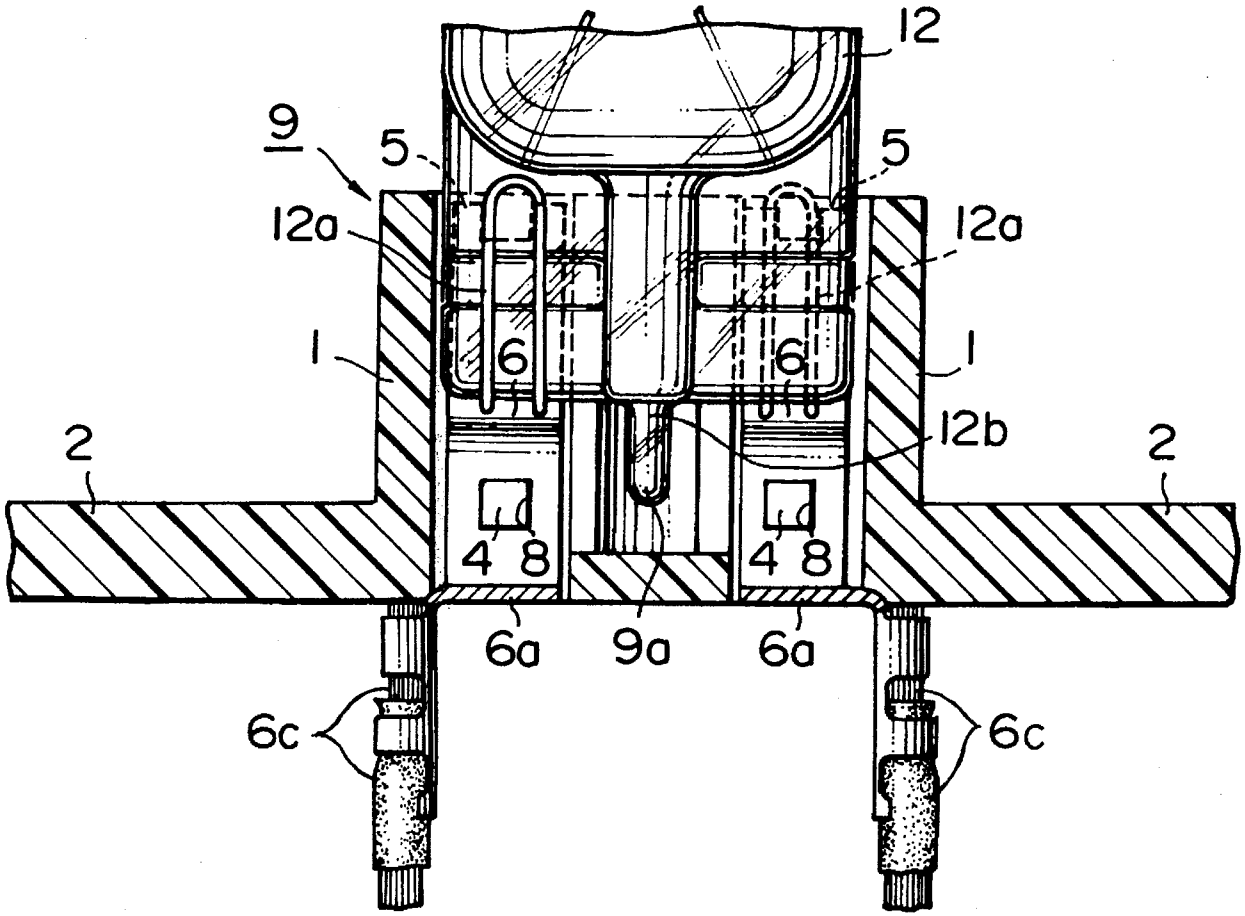
FIG. 9 is a vertical cross-sectional view of the apparatus as an embodiment of the present invention.

The wedge base bulb 12 can also be illuminated by forming lead wire 6, to which the above-mentioned BUS bar portions are connected and secured, in the manner shown in FIGS. 8 and 9 thereby resulting in electrical continuity.

Figure 10:
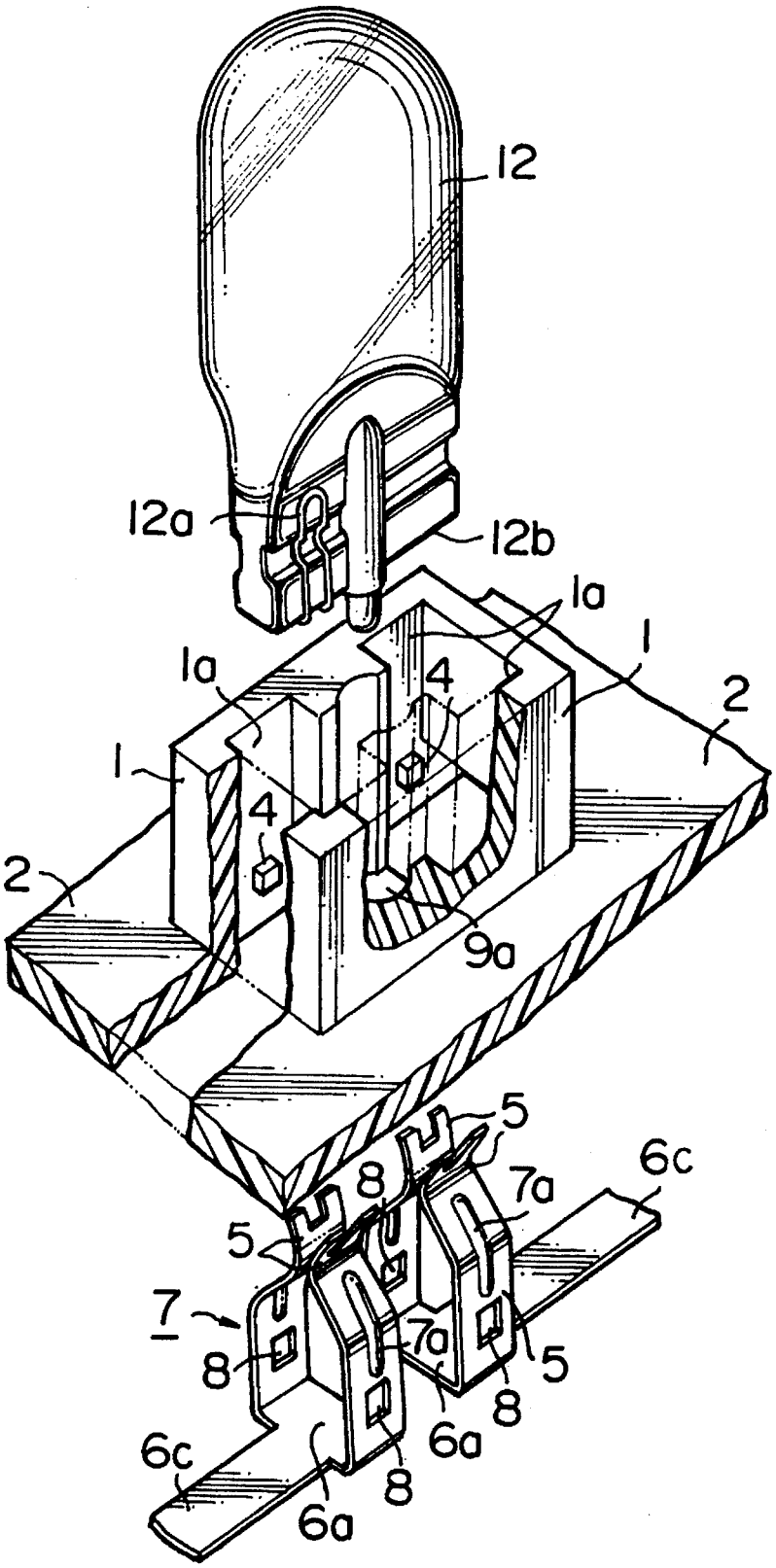
FIG. 10 is an exploded perspective view of an embodiment of the present invention.
Figure 11:
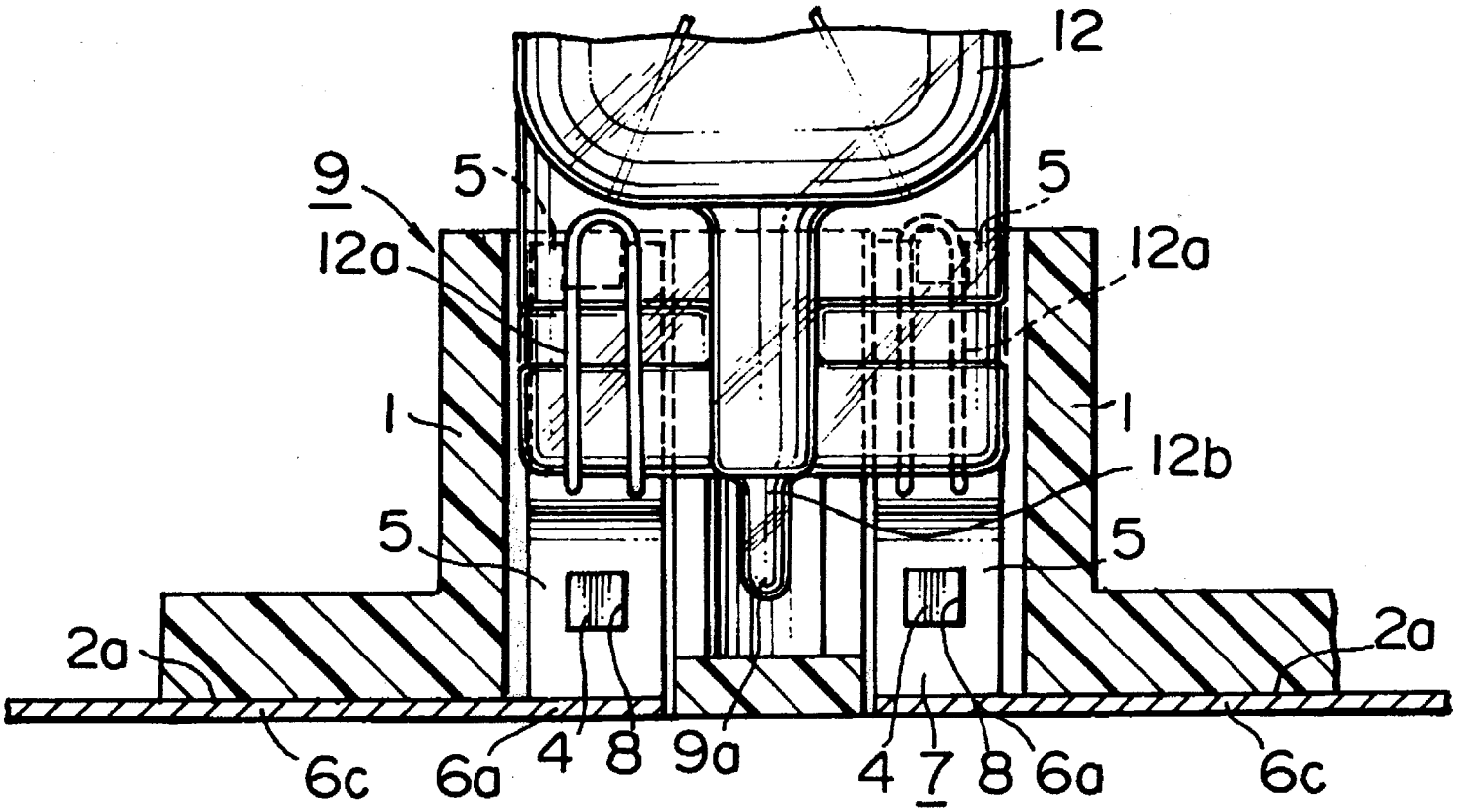
FIG. 11 is a vertical cross-sectional view of the apparatus as an embodiment of the present invention.

The BUS bar portions can also be extended so as to be configured in the manner shown in FIGS. 10 and 11.

As a result of being constructed as explained above, the present invention offers the advantages described below.

Firstly, a relatively small insulated frame 1 may integrally be provided upright on a plastic base 2 having a relatively large area. Also, the lamp or fuse is surrounded by a relatively large open area since the connecting portions of a wedge base bulb or small flat fuse can be connected and tightly held in a pair of connection pieces 6 mounted in parallel by engaging male and female portions within the insulated frame. As a result, the heat generated by the lamp and can be effectively released by convection and radiation so that temperature increases of base 2 and frame 1 are minimal. Thus, there is no thermal deformation even when inexpensive plastic is used for the material of base 2 and frame 1, thereby resulting in advantageous increased safety and excellent economic feasibility. The connectors themselves conserve space and can be cost-effectively manufactured as a result of integrally forming insertion connection pieces 6 with a pair of clamps 5. The tab terminal of BUS bar can be directly and tightly inserted into insertion connection piece 6 thereby resulting in excellent useability due to the ability of the connectors of this invention to be connectable and used with low contact resistance, without the need for caulking rivets or other caulking tools required of conventional connectors. Thus, the connectors of this invention are particularly well suited for be used in an automated assembly process as well as enabling connection work to be performed easily even in confined or dark locations, such as an automobile's engine compartment.

The following discussion relates to other embodiments of the connector in accordance with the present invention.

Figure 12:
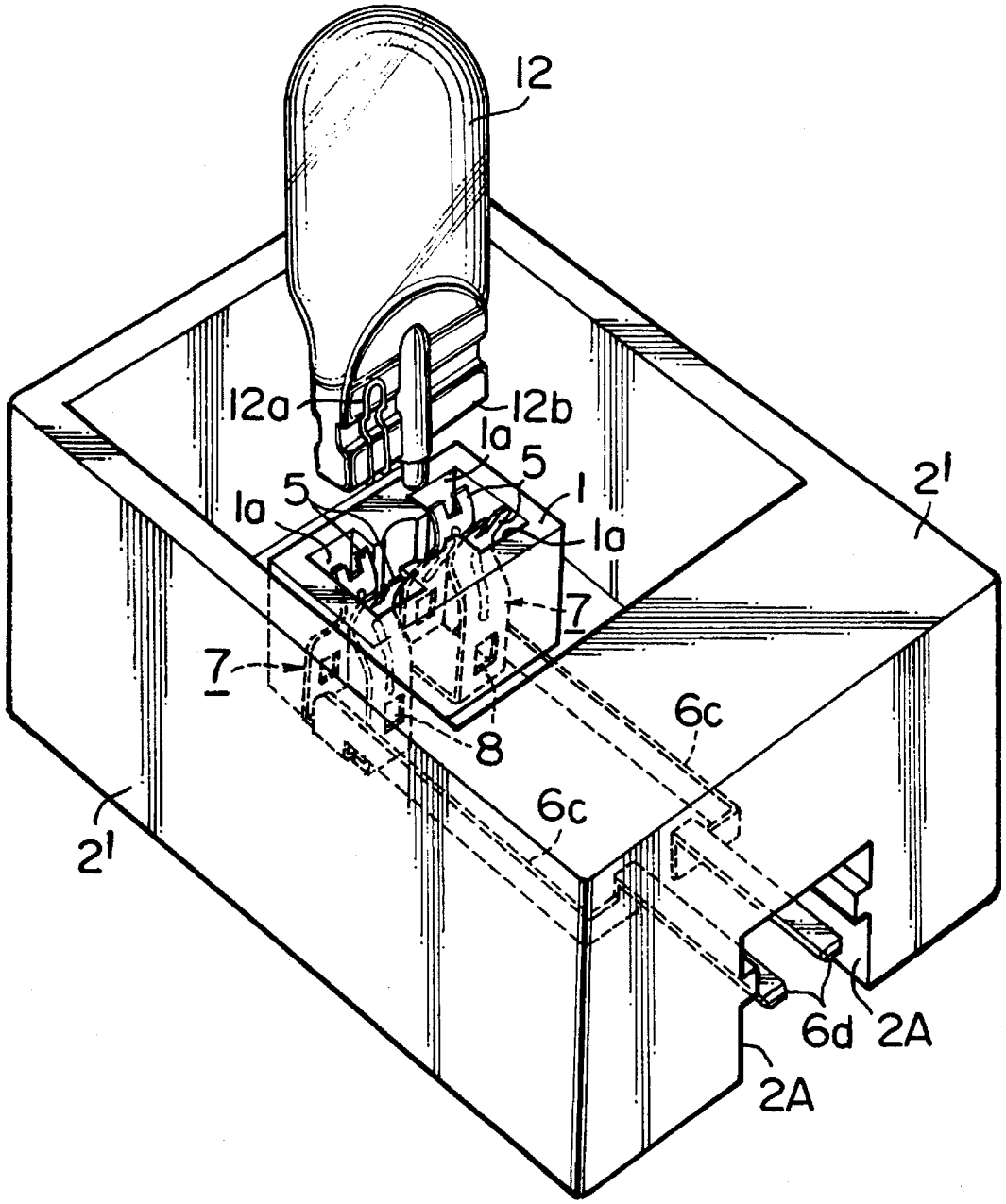
FIG. 12 is a perspective view indicating an embodiment of the present invention.
Figure 13:
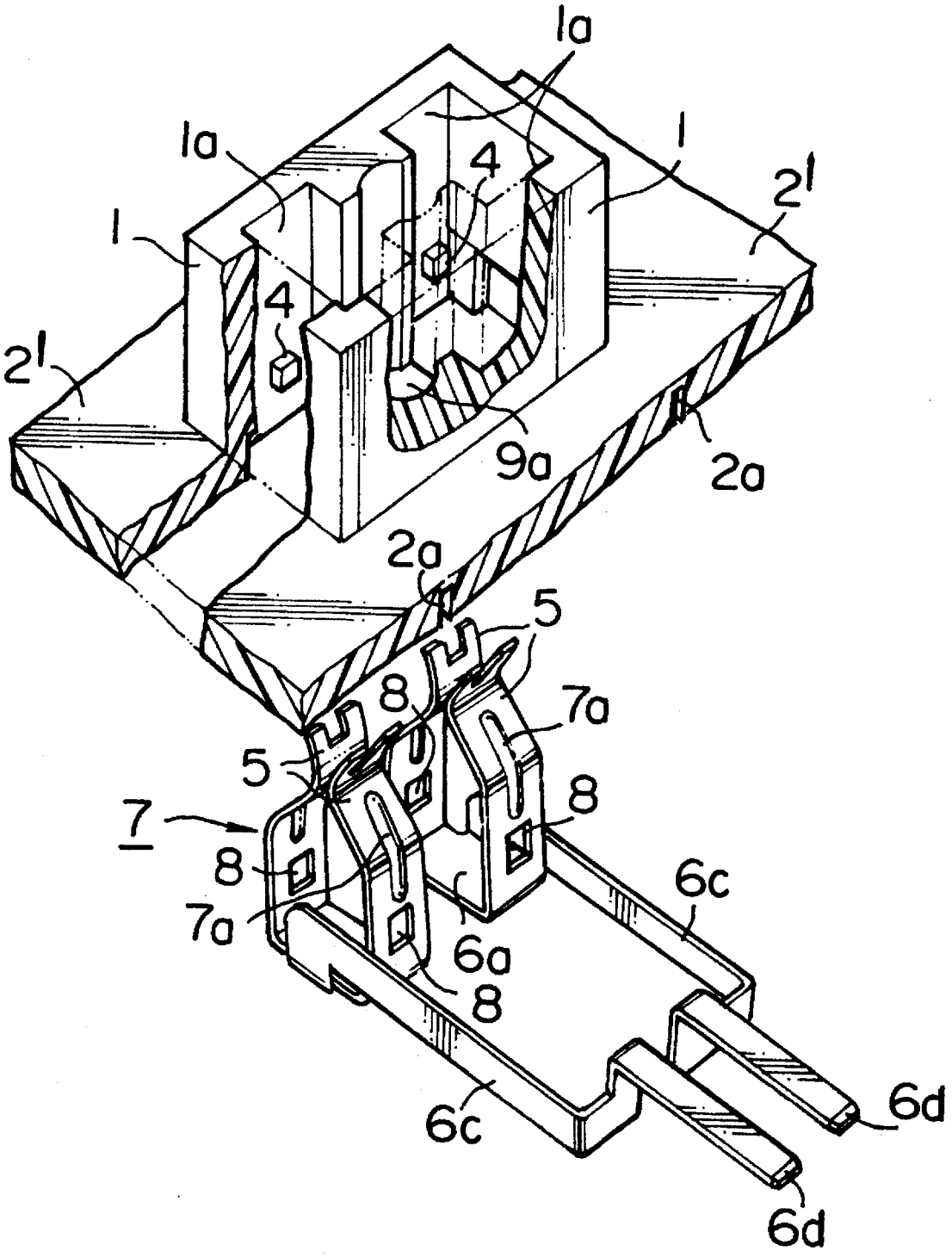
FIG. 13 is an exploded perspective view of the essential portion of the present invention.
Figure 14:
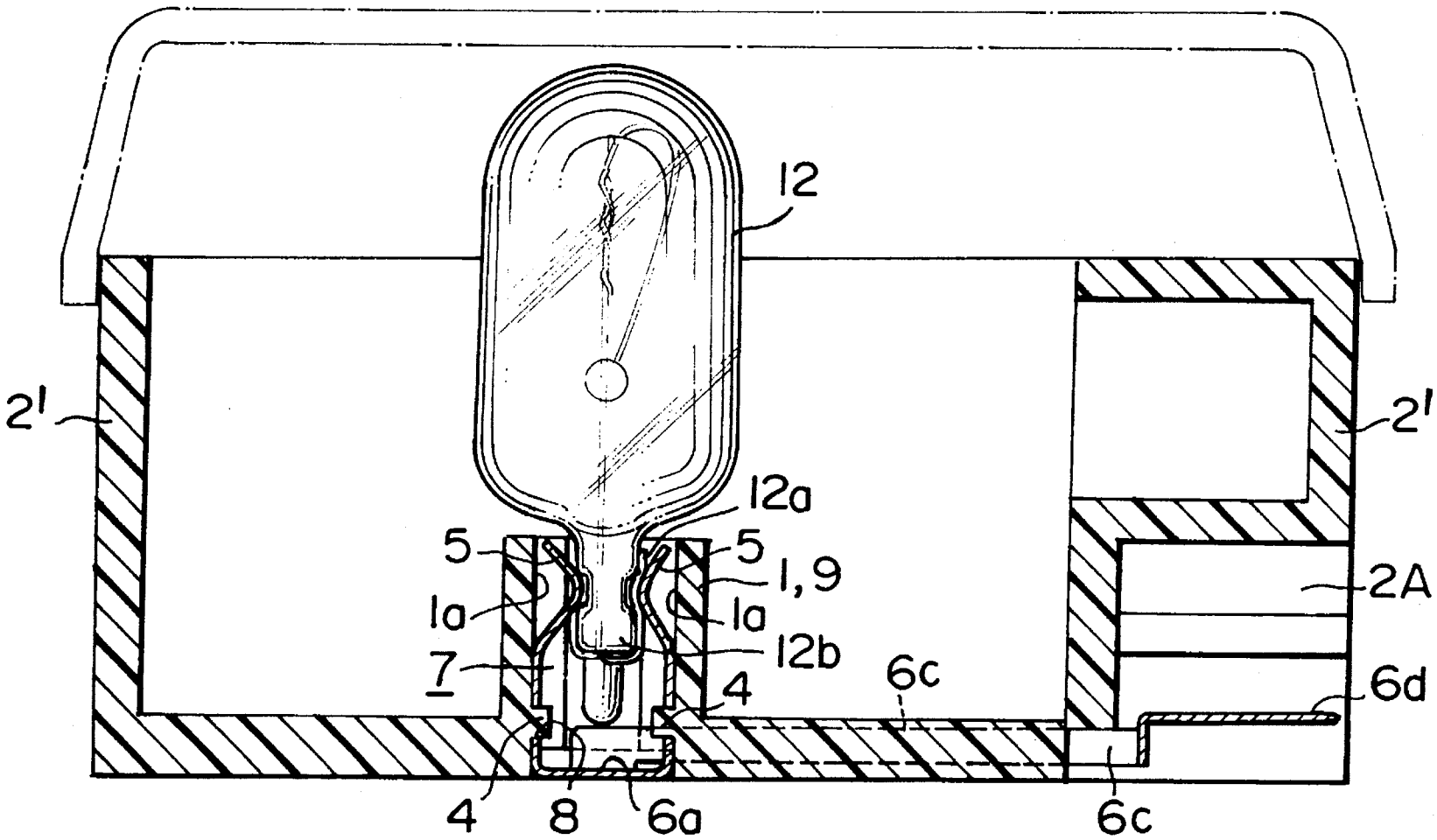
FIG. 14 is a vertical cross-sectional side view of the apparatus of an embodiment of the present invention.
Figure 15:
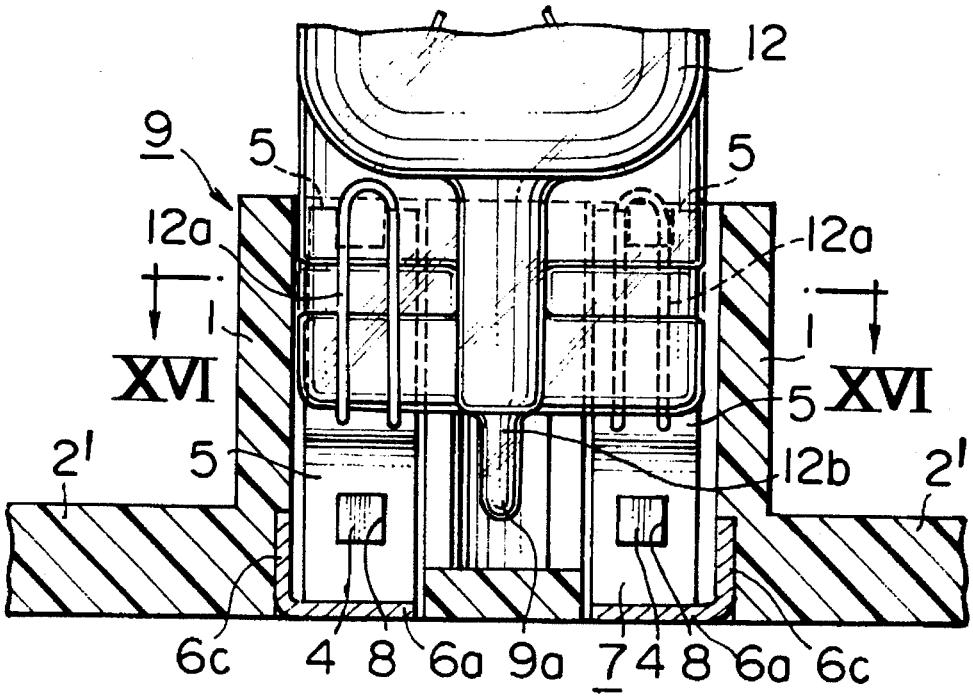
FIG. 15 is a vertical cross-sectional view of the apparatus of the present invention.
Figure 16:
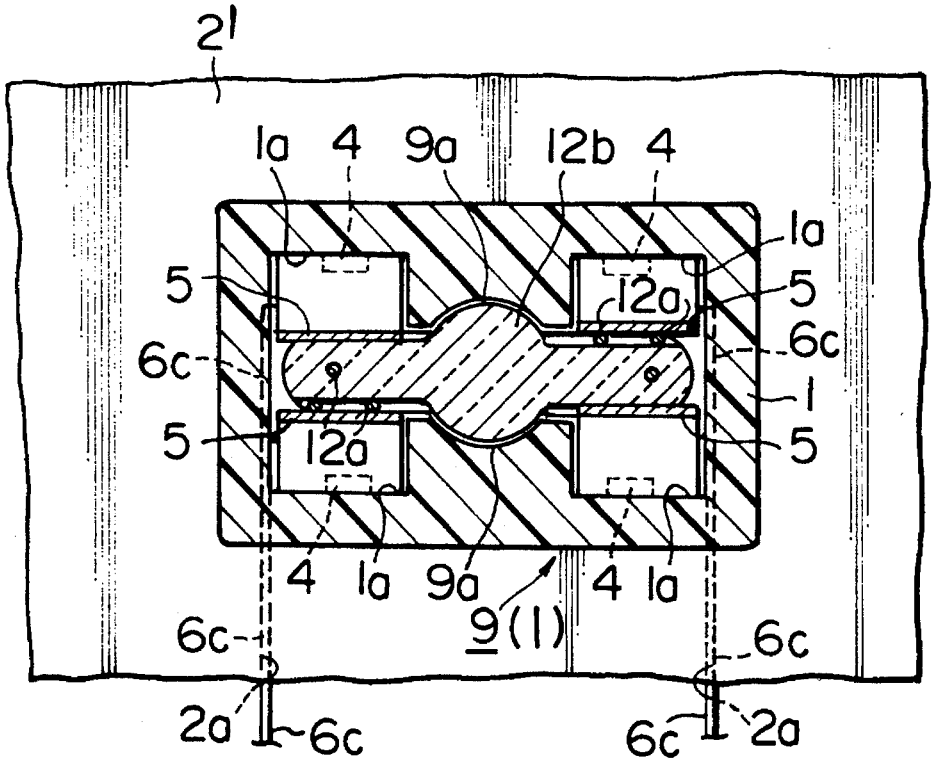
FIG. 16 is a cross-sectional view taken along line XVI—XVI of FIG. 15.
Figure 17:
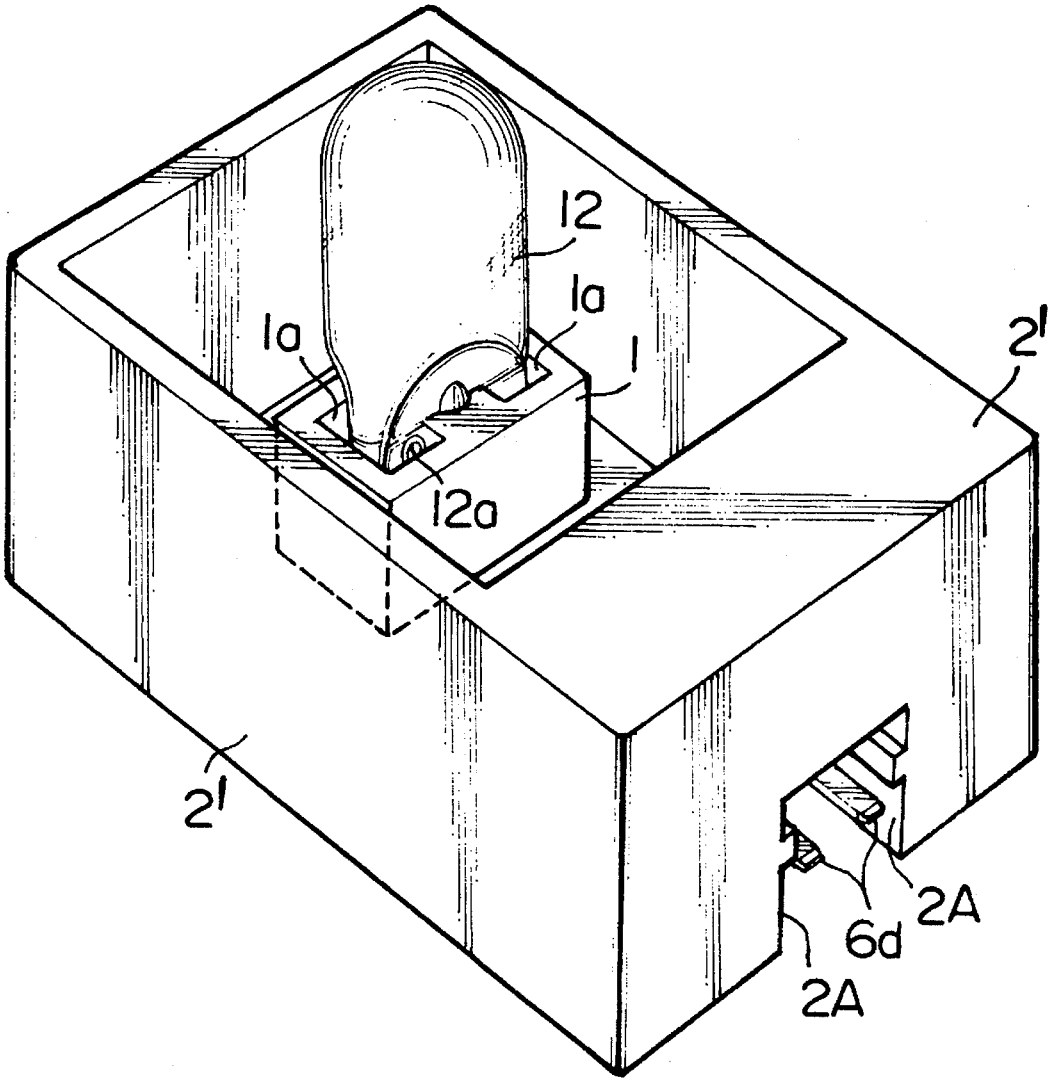
FIG. 17 is a perspective view indicating an example of use of the present invention.
Figure 18:
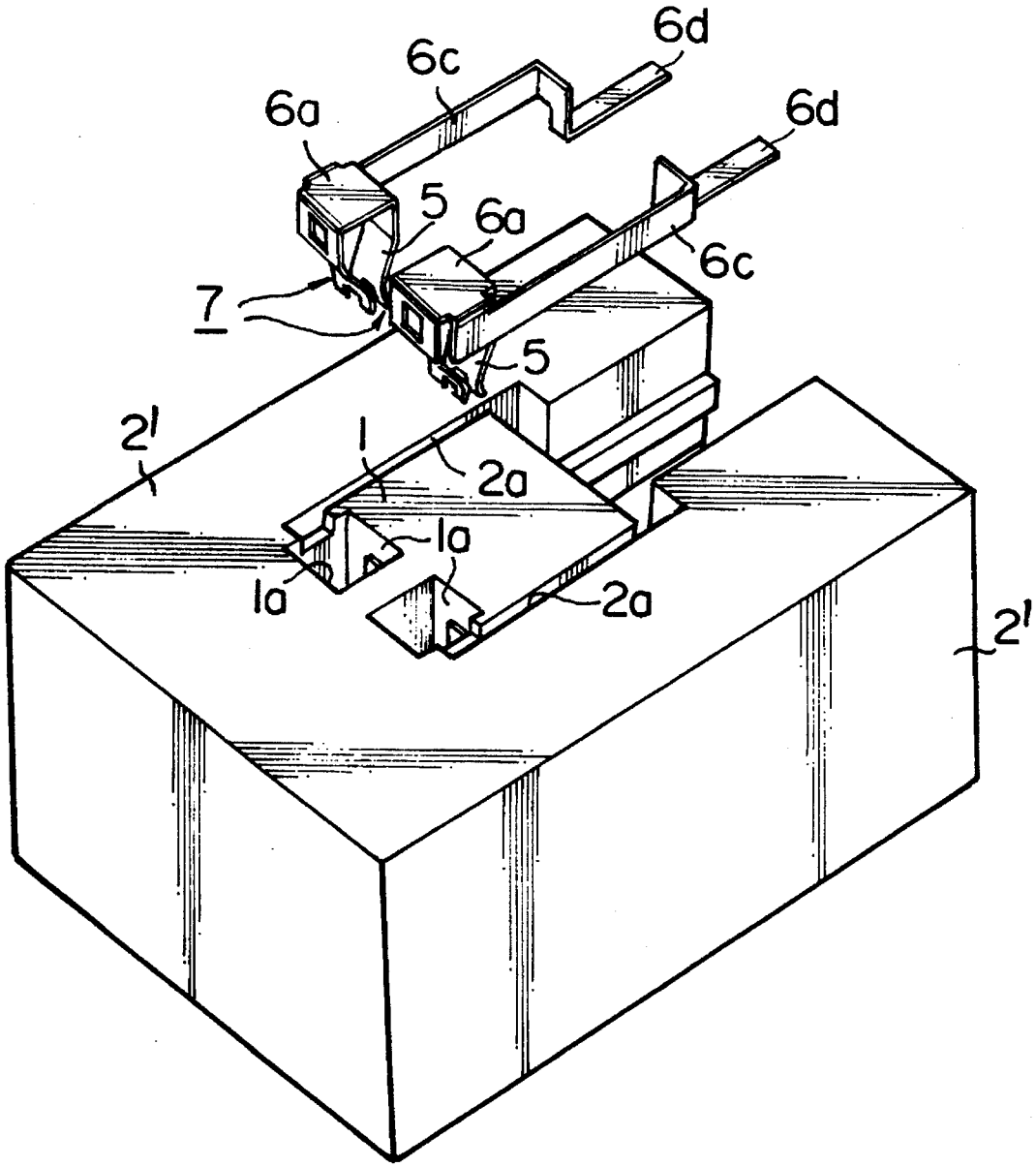
FIG. 18 is a rear perspective view of FIG. 1.

As shown in FIG. 14, the connector attachment component used for attaching an insulated holder is provided with projections 4 protruding in opposition to each other on opposing inner surfaces 1 a of an insulated frame 1. The frame 1 is formed into the shape of a square cylinder as shown in FIG. 12 protruding from the bottom of a box frame 2' made of a heat-resistant plastics material such as polypropylene. A pair of connectors 7 are provided each having a pair of resilient conductive U-shaped clamps 5 formed of phosphor bronze and the like as shown in FIG. 13. The connectors are equipped with a narrow conductive metal strip 6*c* such as a BUS bar integrally provided in such a manner to protrude from base 6*a* of clamps 5 as shown in FIGS. 13 and 18. The connectors 7 are clamped within the insulated frame 1 as shown in FIGS. 12 and 14 through 17.

Figure 19:
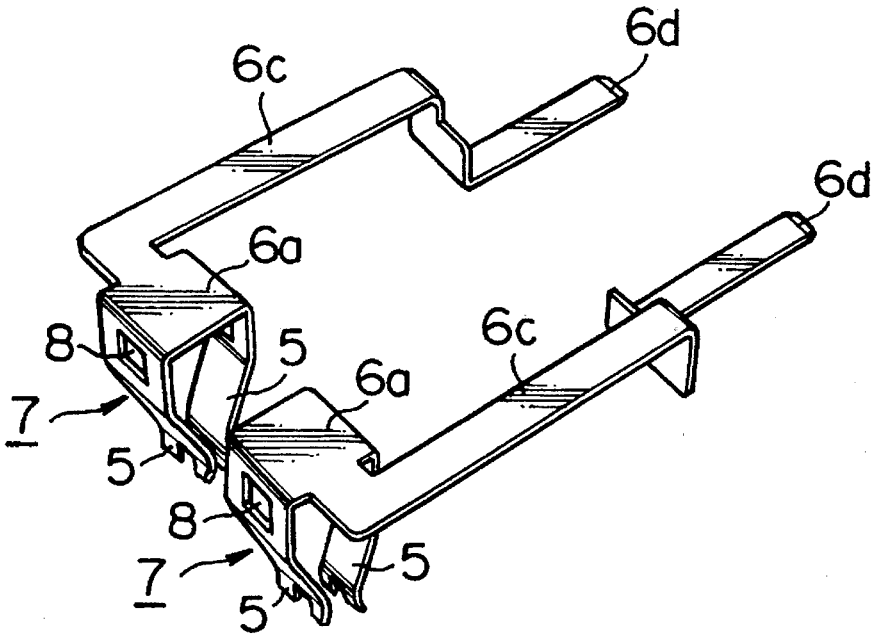
FIG. 19 is a perspective view indicating another example of the apparatus of the present invention.
Figure 20:
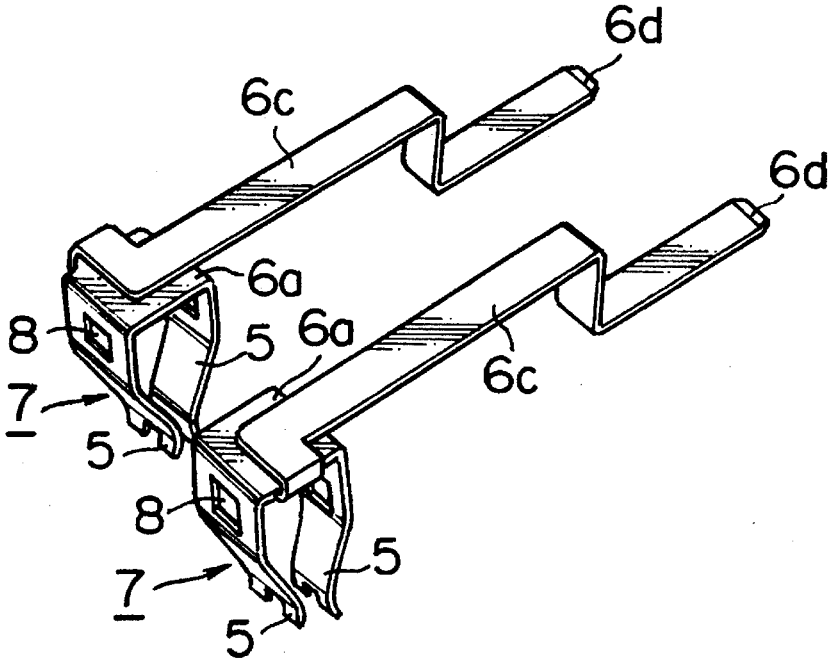
FIG. 20 is a perspective view indicating another example of the apparatus of the present invention.

Narrow conductive metal strip 6*c* may be formed by bending horizontally with respect to clamp base 6*a* as shown in FIG. 19 or may be led out by overlapping base 6*a* as shown in FIG. 10. In addition, the narrow conductive metal strip 6*c* may be fastened by press fitting to base 6*a* or fastened by soldering. At the time of attachment, the pair of projections 4 engage with a snapping action within the attachment holes 8 formed near base 6*a* of clamp 5 as it is being inserted between the opposing inner surfaces 1*a* of the insulated frame 1. The connectors 7 are thereby positioned on both sides between the insulated frame's inner surfaces 1*a* as shown in FIGS. 12 and 14, respectively. The narrow conductive metal strip 6*c* is attached within rear recess groove 2*a* of box frame 2', thus forming the overall bulb holder 9.

If a connector provided with two protruding ribs 7*a* as shown in FIG. 12 is used for the above-mentioned connector 7, clamping resiliency can be strengthened thereby resulting in improved radiation of heat.

The apparatus of the present invention is formed by arranging the extended end 6*d* of the above-mentioned narrow conductive metal strip 6*c* in holder 9 so that it protrudes into connector recess 2A formed in the frame 2'. The bulb 12 may be inserted into the connector in a manner similar to that described previously.

What is claimed is:

1. A connector component for a wedge-base lamp comprising:

an electrically insulative base which includes an upright inverted T-shaped electrically insulated frame member defining a central interior rectangular space for receiving a wedge-base of a lamp, and an opposed pair of lateral shoulder pockets which open into a lower portion of said central interior rectangular space;

a pair of opposed bulb guides integral with said frame member and disposed substantially midway of said interior rectangular space, said opposed bulb guides each defining a respective arcuate concavity for receiving a portion of said wedge-base of said lamp therein so as to provide a holder for said wedge-base lamp;

said bulb guides further defining a pair of lateral socket spaces within said interior rectangular space of said frame member, said socket spaces each having a projection member extending into said socket space;

a pair of U-shaped electrically conductive clamp elements positioned in a respective one of said lateral socket spaces, each said clamp element having (i) an attachment aperture which receives a projection member of a respective said socket space to positionally restrain said clamp element therewithin, and (ii) a lateral connection piece positioned within a respective said lateral shoulder pocket for connection to a bus bar.

* * * * *